US006759756B2

(12) United States Patent
Shiga et al.

(10) Patent No.: US 6,759,756 B2
(45) Date of Patent: Jul. 6, 2004

(54) STARTER FOR CRANKING INTERNAL COMBUSTION ENGINE HAVING MAIN AND AUXILIARY SWITCHES

(75) Inventors: Tsutomu Shiga, Nukata-gun (JP); Masami Niimi, Handa (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/459,473

(22) Filed: Jun. 12, 2003

(65) Prior Publication Data

US 2004/0017086 A1 Jan. 29, 2004

(30) Foreign Application Priority Data

Jul. 25, 2002 (JP) ..... 2002-216041

(51) Int. Cl.[7] ..... F02N 11/00

(52) U.S. Cl. ..... 290/38 R; 290/48; 290/34; 310/68 C

(58) Field of Search ..... 290/38 R, 34, 290/48, 28, 35, 7, 8, 31; 310/68 C

(56) References Cited

U.S. PATENT DOCUMENTS 4,674,344 A * 6/1987 Kazino et al. ..... 74/7 A
4,855,609 A * 8/1989 Eguchi et al. ..... 290/48
4,896,637 A * 1/1990 Yamamoto ..... 123/179.3
5,256,956 A * 10/1993 Tsuchiya et al. ..... 320/128
5,345,901 A * 9/1994 Siegenthaler et al. .... 123/179.3
5,563,454 A * 10/1996 Araki et al. ..... 307/10.6
5,584,655 A * 12/1996 Deering ..... 416/31
5,610,445 A * 3/1997 Shiga et al. ..... 290/38 R
5,621,249 A * 4/1997 Shiga et al. ..... 290/38 R
5,622,148 A * 4/1997 Xue et al. ..... 123/179.25
5,656,981 A * 8/1997 Niimi et al. ..... 335/126
5,767,585 A * 6/1998 Shiga et al. ..... 290/38 R
5,777,393 A * 7/1998 Katoh et al. ..... 290/48
5,789,821 A * 8/1998 Shiga et al. ..... 290/38 R
5,892,421 A * 4/1999 Matsushima ..... 335/126
5,907,204 A * 5/1999 Matsushima et al. ..... 310/68 C
5,945,742 A * 8/1999 Araki et al. ..... 290/38 R
5,994,805 A * 11/1999 Iwamoto et al. ..... 310/68 C
6,020,650 A * 2/2000 Soh ..... 290/38 A
6,054,777 A * 4/2000 Soh ..... 290/38 R
6,114,771 A * 9/2000 Takagi et al. ..... 290/38 R
6,117,772 A * 9/2000 Murzin et al. ..... 438/681
6,452,295 B1 * 9/2002 Iwamoto et al. ..... 310/68 C
6,486,625 B1 * 11/2002 Vilou ..... 318/139

FOREIGN PATENT DOCUMENTS

DE 100 47 288 A1 4/2002
DE 10047288 * 4/2002 ..... F02N/11/08

* cited by examiner

*Primary Examiner*—Burton S. Mullins
*Assistant Examiner*—Heba Elkassabgi
(74) *Attorney, Agent, or Firm*—Oliff & Berridge, PLC

(57) ABSTRACT

A starter includes an electric motor, a pinion gear driven by the electric motor and a magnetic switch having a plunger driven by a magnetic coil. Electric power to be fed to both the electric motor and the magnetic coil is supplied from an on-board battery through a single common input terminal of the starter. The magnetic switch is composed of a main switch through which a full power is supplied to the electric motor and an auxiliary switch through which a limited power is supplied. Upon closing the auxiliary switch, the motor is driven at a low speed and the pinion gear is engaged with a ring gear of the engine. Then, the main switch is closed to thereby crank up the engine with a full power.

5 Claims, 4 Drawing Sheets

STARTER FOR CRANKING INTERNAL COMBUSTION ENGINE HAVING MAIN AND AUXILIARY SWITCHES

CROSS-REFERENCE TO RELATED APPLICATION

This application is based upon and claims benefit of priority of Japanese Patent Application No. 2002-216041 filed on Jul. 25, 2002, the content of which is incorporated herein by reference.

BACKGROUND OF THE INVENTION

1. Field of the Invention

The present invention relates to a starter for cranking an internal combustion engine, the starter having a magnetic switch that includes a main switch and an auxiliary switch.

2. Description of Related Art

An example of a conventional starter for cranking an internal combustion engine is shown in FIG. 5. The starter is composed of an electric motor and a magnetic switch. An input terminal of the starter is connected to an on-board battery. Upon turning on a key-switch, a relay is closed and thereby the magnetic switch is energized. When the magnetic switch is energized, a pinion of the starter is pushed toward a ring gear of the engine and engaged therewith. At the same time, electric current is supplied to the electric motor by closing electric contacts connected to the input terminal. Thus, rotational torque of the electric motor is transferred to the engine through the pinion to thereby crank up the engine.

As shown in FIG. 5, the conventional starter has two terminals, i.e., the input terminal connecting the electric motor to the on-board battery and a switch terminal connecting a magnetic coil of the magnetic switch to the relay. In other words, the starter has to be connected to outside circuits through two lead wires led out from the starter. It is desirable and convenient if the starter could be electrically connected to the circuit of a vehicle with a single lead wire.

To realize the single wire connection, a German patent document DE-10047288-A1 proposes to remove the magnetic switch from the starter and to operate the starter as a mere electric motor in a controlled manner. This proposal, however, involves some problems. To smoothly crank up the engine, a rotational torque of the electric motor has to be transferred to the pinion gear after the pinion gear surely engages with the ring gear of the engine. On the other hand, the pinion gear has to be quickly disengaged from the ring gear after the engine is cranked up. That is, operation of the electric motor has to be well synchronized with the engagement of the pinion gear with the ring gear. This synchronized operation is usually realized by the magnetic switch installed in the starter together with the electric motor. Since the magnetic switch is not included in the starter proposed by DE-10047288-A1, cranking operation of the starter cannot be performed in a sufficiently synchronized manner.

Another example of the single wire starter is a starter for use in a motorcycle. This type of the starter has no magnetic switch for establishing engagement between the pinion gear and the ring gear. The pinion gear is engaged with the ring gear by its inertia (so-called Bendix-type engagement). It has been well known that this type of engagement cannot be perfect. As exemplified above, so-called one-wire starters have not been perfect in their operation and reliability.

SUMMARY OF THE INVENTION

The present invention has been made in view of the above-mentioned problem, and an object of the present invention is to provide an improved starter that is electrically connected by means of a single wire without sacrificing its reliability.

A starter for cranking an internal combustion engine includes an electric motor, a pinion gear driven by the electric motor, and a magnetic switch for engaging the pinion gear with a ring gear of the engine and for energizing or de-energizing the electric motor. The starter also includes an input terminal connected to an on-board battery through a relay operated by a key-switch. Electric power fed to a magnetic coil of the magnetic switch and electric power fed to the electric motor are commonly supplied from the single input terminal connected to the on-board battery.

The magnetic switch includes a plunger driven by the magnetic coil, a main switch and an auxiliary switch. Both the main switch and the auxiliary switch are turned on and off in response to movement of the plunger. Both switches are connected in parallel to each other and disposed between the input terminal and the electric motor. The auxiliary switch includes an electric resistor for restricting amount of current supplied to the electric motor. The electric resistor may be formed in a stationary contact of the auxiliary switch, the stationary contact being made of a carbon material. The main switch includes no resistor so that a full current is supplied to the electric motor when the main switch is closed.

Upon turning on the key-switch, the magnetic coil in the magnetic switch is energized. Upon energizing the magnetic coil, the plunger is driven and the auxiliary switch is closed by the plunger, and a limited amount of current is supplied to the electric motor, thereby rotating the electric motor at a low speed. At the same time, the pinion gear is engaged with the ring gear in response to the movement of the plunger. This engagement may be established by pushing the pinion gear toward the ring gear while stopping rotation of the pinion gear. As the plunger is further driven, the main switch is closed, and thereby a full amount of electric current is supplied to the electric motor. The pinion gear engaging with the ring gear is fully driven by the electric motor, and the engine is cranked up. After the engine is cranked up, the key-switch is turned off to terminate power supply to the starter.

The main switch may be constituted by a stationary contact and a movable contact. Alternatively, it may be constituted by utilizing a contact between a commutator of the electric motor and brushes slidably contacting the commutator. In this case, the brushes are separated from the commutator when the starter is not in operation, and the contact therebetween is established by the movement of the plunger of the magnetic switch.

According to the present invention, the starter that is able to be electrically connected to an on-board system with a single wire is realized without sacrificing functions of the magnetic switch. Other objects and features of the present invention will become more readily apparent from a better understanding of the preferred embodiments described below with reference to the following drawings.

DETAILED DESCRIPTION OF THE PREFERRED EMBODIMENTS

Figure 1:
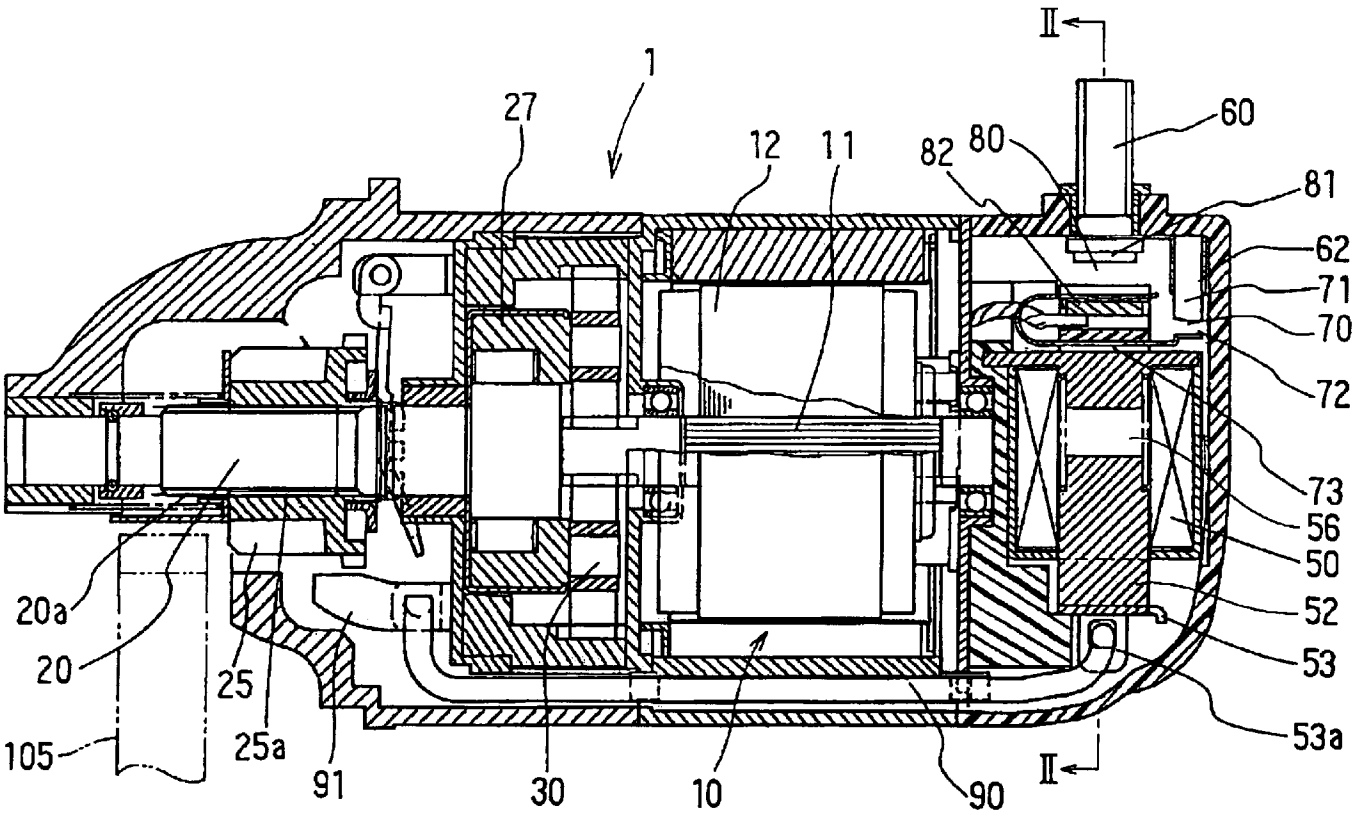
FIG. 1 is a cross-sectional view showing an entire structure of a starter as a first embodiment of the present invention.
Figure 2:
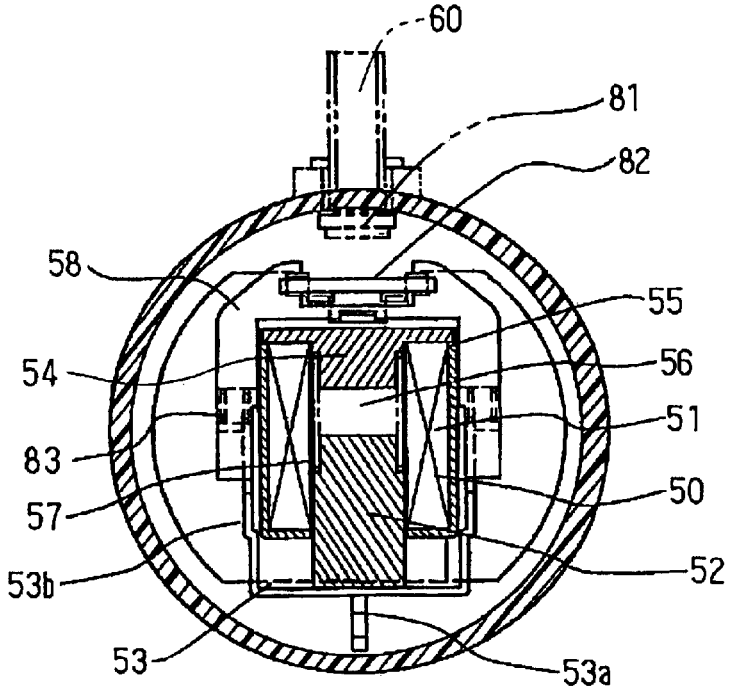
FIG. 2 is a cross-sectional view showing a magnetic switch used in the starter, taken along line II—II shown in FIG. 1.

A first embodiment of the present invention will be described with reference to FIGS. 1–3. A starter 1 includes an electric motor 10, an output shaft 20 carrying a pinion gear 25 thereon, a magnetic switch 50, and other associated components. The structure of the magnetic switch 50 is shown in FIGS. 1 and 2. The magnetic switch 50 includes a magnetic coil 51 for generating an electromagnetic pulling force and components forming a magnetic circuit, i.e., a plunger 52, case 55, and an end plate 54. An air gap 56 is formed between the plunger 52 and the end plate 54. The magnetic switch 50 further includes a main switch 80 and an auxiliary switch 70, both adapted to be operated in response to movement of the plunger 52.

The auxiliary switch 70 is composed of a stationary contact 71 and a movable contact 72. The stationary contact 71 is made of 100% carbon (graphite or the like) or carbon containing a metallic material not more than 10%. The movable contact 72 is made as a portion of a resilient member 73 (a spring member). The resilient member 73 is made of a conductive material having a certain mechanical strength such as phosphor bronze. Since the stationary contact 71 is made of a carbon material, it has an electric resistance of about 50 m Ω and functions as a resistor in the auxiliary switch 70. The main switch 80 is composed of a stationary contact 81 and a movable contact 82.

Figure 3:
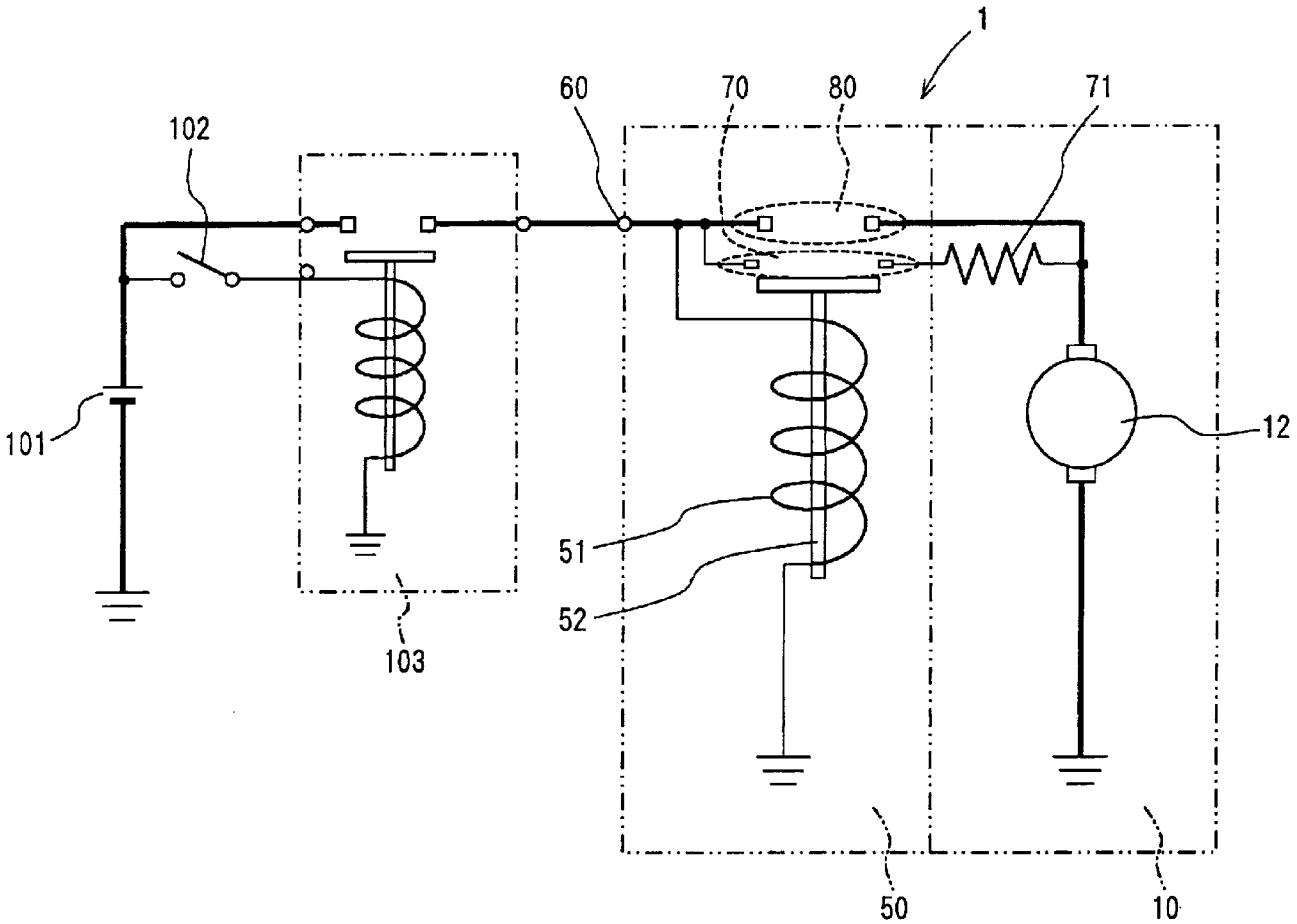
FIG. 3 is a circuit diagram showing electrical connections of the starter.
Figure 5:
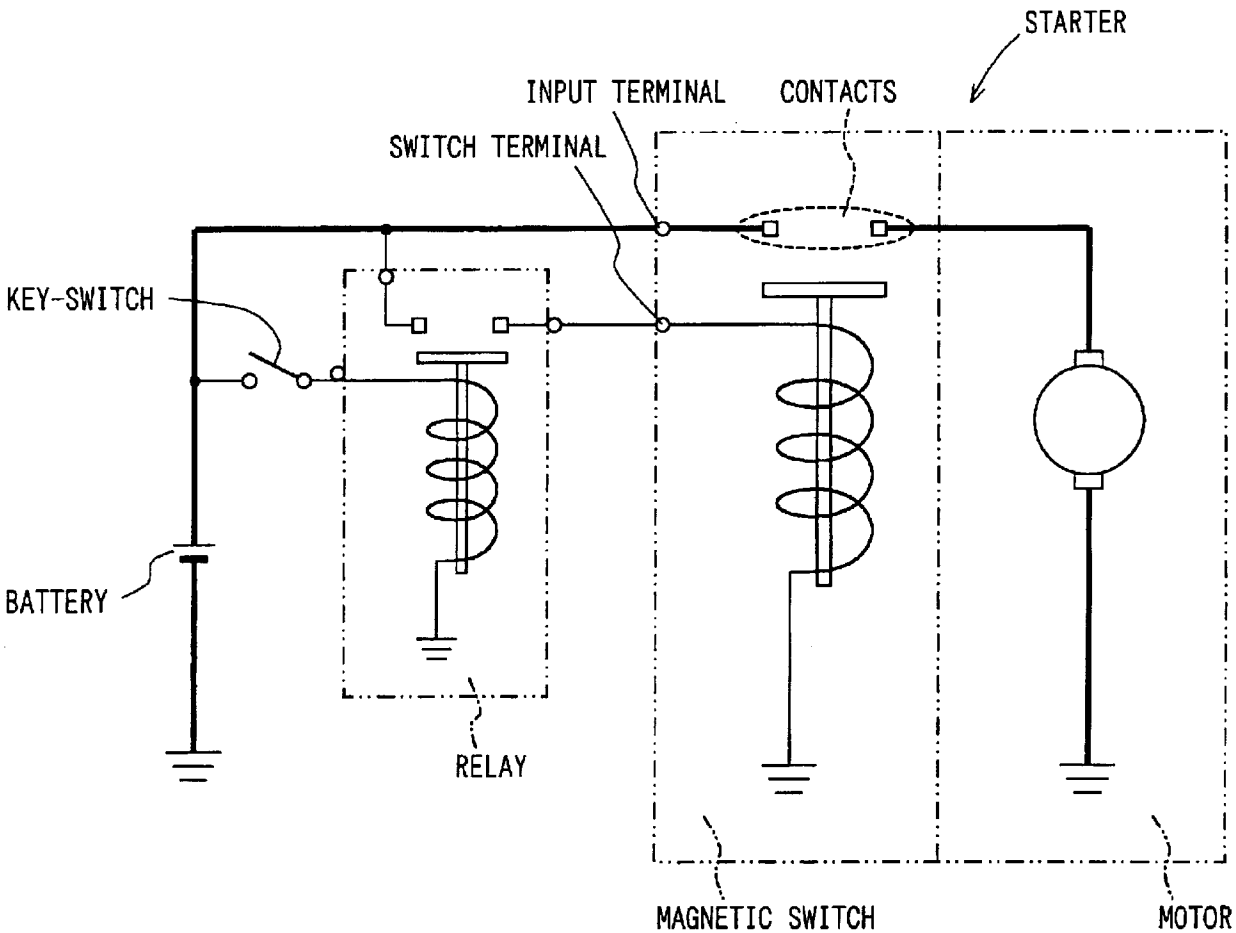
FIG. 5 PRIOR ART
FIG. 5 is a circuit diagram showing electrical connections of a conventional starter.

As shown in FIG. 3, the main switch 80 and the auxiliary switch 70 are connected in parallel to each other and disposed between an input terminal 60 and the electric motor 10. The input terminal 60 is connected to the on-board battery 101 through a relay 103 that is closed upon turning on a key-switch 102. The stationary contact 71 of the auxiliary switch 70 is connected to the input terminal 60 through a holder 62 (refer to FIG. 1), and the stationary contact 81 of the main switch 80 is directly connected to the input terminal 60.

A flange 53 and a connecting member 53*a* are fixedly connected to an end of the plunger 52. An outer tip 53*b* of the flange 53 is coupled to a holder 58 via the resilient member 83. The movable contacts 72 and 82 are fixed to the holder 58. When the plunger 52 moves toward the end plate 54, the flange 53, the holder 58 and movable contacts 72, 82 move together with the plunger 52. Thus, the main switch 80 and the auxiliary switch 70 operate in response to the movement of the plunger 52.

As shown in FIG. 1, one end of a connecting rod 90 is inserted into a hole of the connecting member 53*a*, and the other end of the connecting rod 90 is connected to a stopper member 91. When the magnetic coil 51 is energized, the plunger 52 moves in a direction to decrease the air gap 56. In response to the movement of the plunger 52, the stopper member 91 connected to the connecting rod 90 moves upwardly to thereby engage with the pinion gear 25. Thus, rotation of the pinion gear 25 is prevented by the stopper member 91. When the electric motor 10 is driven under this condition, the pinion gear 25, which is coupled to the output shaft 20 via skewed splines 25*a* of the pinion 25 and skewed splines 20*a* of the output shaft 20, is pushed toward the ring gear 105 of the engine to be engaged therewith. An armature shaft 11 connected to an armature 12 of the electric motor 10 is coupled to the output shaft 20 via a speed-reduction mechanism 30 and a clutch 27. A return spring 57 is disposed between the plunger 52 and the end plate 54 (as shown in FIG. 2), so that the plunger 52 is biased toward its initial position.

The starter 1 described above operates as follows. Upon turning on the key-switch 102, the relay 103 is closed and a voltage of the battery 101 is supplied to the input terminal 60. The magnetic coil 51 of the magnetic switch 50 is energized, and thereby the plunger 52 moves in the direction to decrease the air gap 56 against the biasing force of the return spring 57. According to the movement of the plunger 52, the stopper member 91 engages with the pinion gear 25 to thereby prevent rotation of the pinion gear 25. Then, the auxiliary switch 70 is closed to thereby supply electric current to the electric motor 10. Since the electric current is supplied through the resistance in the stationary contact 71, the electric motor 10 rotates at a low speed. According to the rotation of the electric motor 10, the pinion gear 25 is pushed forward to engage with the ring gear 105 because the pinion rotation is restricted by the stopper member 91 at this moment.

As the plunger 52 further moves, decreasing the air gap 56, the main switch 80 is closed. At this moment, a full amount of electric current is supplied to the electric motor 10 through the main switch 80 because the main switch 80 connected in parallel with the auxiliary switch 70 has no resistor. Thus, the electric motor 10 is fully powered and the engine is cranked up. After the engine is cranked up, the key-switch 102 is turned off. The magnetic coil 51 is de-energized, and the plunger 52 is returned to its original position by the biasing force of the return spring 57. According to the returning movement of the plunger 52, the main switch 80 is first turned off, and then the auxiliary switch 70 is turned off. Since the engaging operation of the pinion gear 25 is similar to that disclosed in JP-A-10-115274, its details will not be described here.

According to the present invention described above, the starter 1 has only one lead wire led out from the input terminal 60. Therefore, the starter 1 can be easily installed on the vehicle, and its operation can be easily controlled. Since the magnetic switch 50 is included in the starter 1, the pinion engagement with the ring gear 105 and the operation of the electric motor 10 can be performed in a fully controlled manner. Further, since the pinion engagement is performed by stopping rotation of the pinion without using a lever for shifting the pinion gear 25, the magnetic switch 50 can be made compact in size. The starter 1 according to the present invention is suitably used as a starter for an engine which is controlled under a so-called idling stop system.

Figure 4:
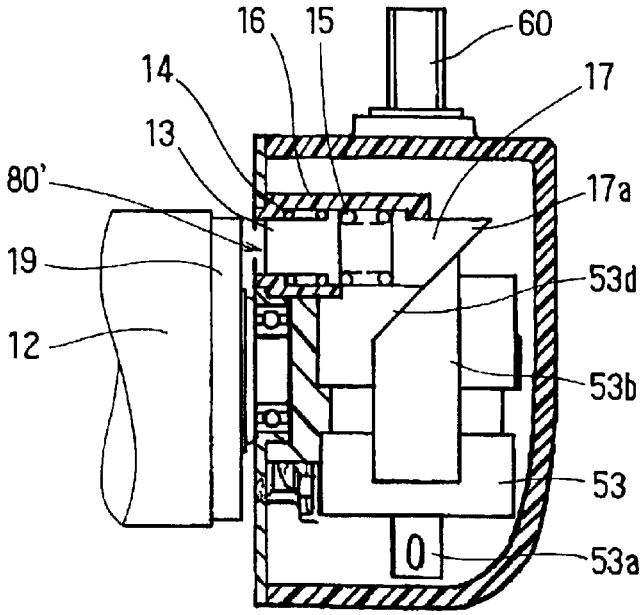
FIG. 4 is a cross-sectional view showing a magnetic switch and its vicinity as a second embodiment of the present invention.

A second embodiment of the present invention will be described with reference to FIG. 4. In this embodiment, a surface-type commutator 19 is used, and the main switch 80 used in the first embodiment is modified. Other structures are the same as those in the first embodiment described above. A modified main switch 80' is composed of the surface-type commutator 19 and a brush 13 slidably contacting an axial surface of the surface-type commutator 19. The brush 13 is directly connected to the input terminal 60 via a pig-tail (not shown) of the brush 13. The brush 13 is supported in a brush holder 16 together with a return spring 14, a setting spring 15 and a spring receiver 17.

When the starter 1 is not in operation, i.e., the magnetic coil 51 is not energized, the brush 13 is separated from the surface-type commutator 19 by a biasing force of the return spring 14 against a spring force of the setting spring 15. Upon energization of the magnetic coil 51, the outer tip 53*b* of the flange 53 is pushed against the spring receiver 17. The outer tip 53*b* has a tapered surface 53*d* which slidably contacts a tapered surface 17*a* of the spring receiver 17. As the spring receiver 17 is pushed in its axial direction, the setting spring 15 is compressed. When the setting spring 15 is compressed to a degree that overcomes the biasing force of the return spring 14, the brush 13 contacts the surface-type commutator 19.

Since the surface-type commutator 19 and the brush 13 constitute the main switch 80', the main switch 80' is closed when the brush 13 contacts the surface-type commutator 19. The main switch 80' is opened when the magnetic coil 51 is de-energized. The auxiliary switch 70 operates in the same manner as in the first embodiment, and the starter 1 as a whole operates in the similar manner as in the first embodiment. According to second embodiment, the main switch 80' can be constituted without using the stationary contact 81 and the movable contact 82.

While the present invention has been shown and described with reference to the foregoing preferred embodiments, it will be apparent to those skilled in the art that changes in form and detail may be made therein without departing from the scope of the invention as defined in the appended claims.

What is claimed is:

1. A starter for cranking an internal combustion engine having a ring gear, the starter comprising:

an input terminal connected to an on-board battery;

an electric motor powered by the on-board battery;

a pinion gear driven by the electric motor, the pinion gear being adapted to be engaged with the ring gear; and a magnetic switch for engaging the pinion gear with the ring gear and for electrically connecting and disconnecting the input terminal to the electric motor, the magnetic switch including a magnetic coil for driving the magnetic switch, wherein:

the magnetic coil is directly connected to the input terminal;

the input terminal is connected to the on-board battery through a relay separated from the starter;

the magnetic switch includes a main switch and an auxiliary switch connected in parallel to the main switch, both of the main and auxiliary switched being disposed between the input terminal and the electric motor; and the auxiliary switch includes an electric resistor for limiting an amount of current supplied to the electric motor.

2. The starter as in claim 1, wherein:

upon energizing the magnetic coil, the auxiliary switch is first closed and then the main switch is closed.

3. The starter as in claim 2, wherein:

the electric resistor of the auxiliary switch is formed in its stationary contact substantially made of carbon.

4. The starter as in claim 2, wherein:

the electric motor includes a rotating armature having a commutator slidably contacting brushes for supplying electric current to the armature; and a contact between the commutator and the brushes is utilized as the main switch.

5. A starter for cranking an internal combustion engine having a ring gear, the starter comprising:

an input terminal connected to an on-board battery;

an electric motor powered by the an one-board battery;

a pinion gear driven by the electric motor, the pinion gear being adapted to be engaged with the ring gear;

a magnetic switch for engaging the pinion gear with the ring gear and for electrically connecting and disconnecting the input terminal to the electric motor, the magnetic switch including a magnetic coil for driving the magnetic switch; and a speed-reduction mechanism disposed between the electric motor and the pinion gear for driving the pinion gear at a reduced speed, wherein:

the magnetic coil is directly connected to the input terminal;

the pinion gear is engaged with the ring gear by pushing the pinion gear towards the ring gear while stopping rotation of the pinion gear upon energization of the magnetic switch; and the pinion gear is positioned at one axial side of the electric motor while the magnetic switch is positioned at the other axial side of the electric motor.

* * * * *